US011681246B2

(12) United States Patent
Hoshino

(10) Patent No.: US 11,681,246 B2
(45) Date of Patent: Jun. 20, 2023

(54) IMAGE FORMING APPARATUS WITH ADJUSTABLE SPEED TRANSFER ROLLER

(71) Applicant: FUJIFILM Business Innovation Corp., Tokyo (JP)

(72) Inventor: Takashi Hoshino, Kanagawa (JP)

(73) Assignee: FUJIFILM Business Innovation Corn., Tokyo (JP)

( * ) Notice: Subject to any disclaimer, the term of this patent is extended or adjusted under 35 U.S.C. 154(b) by 0 days.

(21) Appl. No.: 17/579,848

(22) Filed: Jan. 20, 2022

(65) Prior Publication Data

US 2023/0064405 A1 Mar. 2, 2023

(30) Foreign Application Priority Data

Aug. 25, 2021 (JP) ..... JP2021-137635

(51) Int. Cl.
*G03G 15/00* (2006.01)
*G03G 15/16* (2006.01)
*G03G 15/01* (2006.01)

(52) U.S. Cl.
CPC ..... *G03G 15/1615* (2013.01); *G03G 15/0136* (2013.01); *G03G 2215/1614* (2013.01); *G03G 2215/1623* (2013.01)

(58) Field of Classification Search
CPC ..... G03G 15/0136; G03G 15/1615; G03G 2215/1614; G03G 2215/1623
USPC ..... 399/167, 302, 308
See application file for complete search history.

(56) References Cited

U.S. PATENT DOCUMENTS 6,057,869 A 5/2000 Kawaishi et al.
8,433,220 B2 4/2013 Hoshino
8,712,299 B2 * 4/2014 Sugita ..... G03G 15/0131 430/48
2010/0260512 A1 10/2010 Imamura et al.
(Continued)

FOREIGN PATENT DOCUMENTS

JP 2010-128201 A 6/2010
JP 2010-139952 A 6/2010
(Continued)

OTHER PUBLICATIONS

Extended European Search Report dated Aug. 19, 2022 from the European Patent Office in EP Application No. 22166233.1.

*Primary Examiner* — Hoan H Tran
(74) *Attorney, Agent, or Firm* — Sughrue Mion, PLLC

(57) ABSTRACT

An image forming apparatus includes: an annular transfer belt to which an image is transferred; a transfer roller that transfers an image to a recording medium when the recording medium passes through a transfer area formed between the transfer roller and the transfer belt; a drive mechanism that causes the transfer roller to rotate; and a speed adjustment mechanism that adjusts a rotational speed of the transfer roller achieved by the drive mechanism in units of a cycle of the transfer roller, and switches between a first adjustment pattern and a second adjustment pattern to execute switched adjustment pattern in a cycle including a state in which the transfer roller transports the recording medium, the first adjustment pattern for adjusting the rotational speed of the transfer roller, the second adjustment pattern for adjusting the rotational speed of the transfer roller with a pattern different from the first adjustment pattern.

20 Claims, 8 Drawing Sheets

(56) References Cited

U.S. PATENT DOCUMENTS

| | | | |
|---|---|---|---|
| 2010/0303514 | A1 | 12/2010 | Ishii et al. |
| 2011/0058830 | A1 | 3/2011 | Saka et al. |

FOREIGN PATENT DOCUMENTS

| | | | |
|---|---|---|---|
| JP | 2012-220812 | A | 11/2012 |
| JP | 2021-009192 | A | 1/2021 |

* cited by examiner

IMAGE FORMING APPARATUS WITH ADJUSTABLE SPEED TRANSFER ROLLER

CROSS-REFERENCE TO RELATED APPLICATIONS

This application is based on and claims priority under 35 USC 119 from Japanese Patent Application No. 2021-137635 filed Aug. 25, 2021.

BACKGROUND

(i) Technical Field

The present disclosure relates to image forming apparatus.

(ii) Related Art

Japanese Unexamined Patent Application Publication No. 2012-220812 discloses an image forming apparatus having a belt-shaped image carrier, and a transfer roller in a shape with part of the cylindrical circumferential surface cut-off. In the image forming apparatus, a speed variation of an intermediate transfer belt, which occurs at a second transfer position due to rotation of a second transfer roller, is absorbed by two tension rollers, and an influence on image formation is reduced.

SUMMARY

In an image forming apparatus, a load generated between a transfer belt and a transfer roller may differ between two states: one state in which a recording medium transported to a transfer roller passes through a transfer area where an image is transferred to the recording medium, and the other state in which the recording medium is not passing through the transfer area. In relation to this, an image transferred to the recording medium may be distorted due to the presence or absence of a recording medium in the transfer area.

Aspects of non-limiting embodiments of the present disclosure relate to providing an image forming apparatus that prevents distortion of an image transferred to a recording medium, as compared with when a transfer roller is controlled in drive without considering whether a transfer roller transports a recording medium.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including: an annular transfer belt having an outer circumferential surface to which an image is transferred; a drive roller on which the transfer belt is wound to cause the transfer belt to move; a transfer roller that transfers an image to a recording medium when the recording medium passes through a transfer area which is formed between the transfer roller and the transfer belt; a drive mechanism that causes the transfer roller to rotate; and a speed adjustment mechanism that adjusts a rotational speed of the transfer roller achieved by the drive mechanism in units of a cycle of the transfer roller, and switches between a first adjustment pattern and a second adjustment pattern to execute switched adjustment pattern in a cycle including a state in which the transfer roller transports the recording medium, the first adjustment pattern for adjusting the rotational speed of the transfer roller, the second adjustment pattern for adjusting the rotational speed of the transfer roller with a pattern different from the first adjustment pattern.

BRIEF DESCRIPTION OF THE DRAWINGS

Exemplary embodiment of the present disclosure will be described in detail based on the following figures, wherein:

FIG. 7A is a graph illustrating a variation in the torque value of the drive roller before adjustment is made by the speed adjustment mechanism, FIG. 7B is a graph illustrating a variation in the amount of speed adjustment to a transfer cylinder for which adjustment is made by the speed adjustment mechanism, and FIG. 7C is a graph illustrating a variation in the torque value of the drive roller after adjustment is made by the speed adjustment mechanism; FIG. 8A is a graph illustrating a variation in the amount of speed adjustment to a transfer cylinder for which adjustment is made by the speed adjustment mechanism, and FIG. 8B is a graph illustrating a variation in the torque value of the drive roller after adjustment is made by the speed adjustment mechanism.

DETAILED DESCRIPTION

Hereinafter, an exemplary embodiment for implementing the present disclosure will be described with reference to the drawings. Note that in the following, the range necessary for description for achieving the object of the present disclosure is schematically shown. The range necessary for description of the relevant part of the present disclosure will be principally described, and part for which description is omitted is implemented by a publicly known technique.

First Exemplary Embodiment

Figure 1:
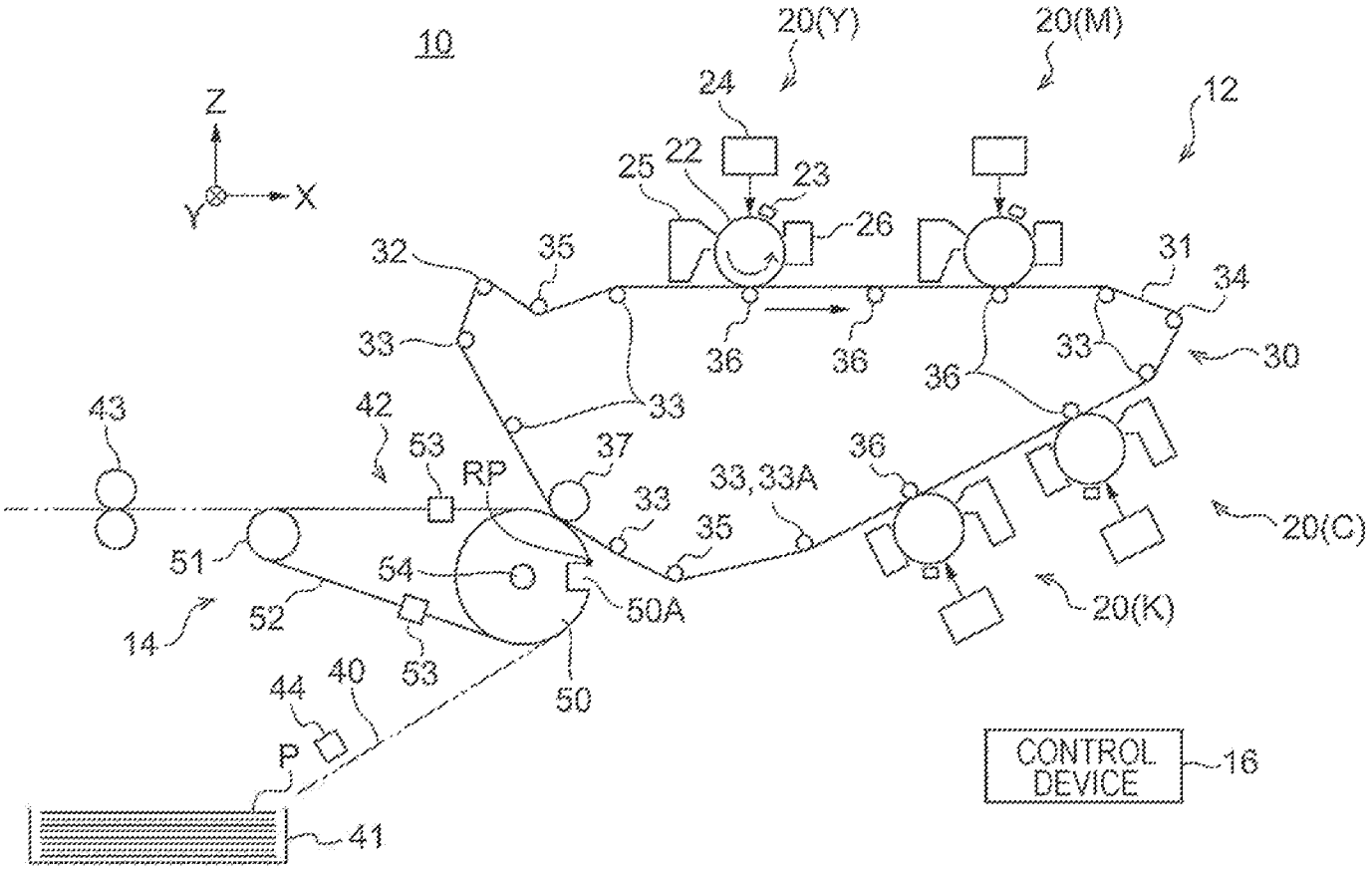
FIG. 1 is a schematic diagram illustrating an example of an image forming apparatus according to a first exemplary embodiment of the present disclosure.

FIG. 1 is a schematic explanatory diagram illustrating an example of an image forming apparatus according to a first exemplary embodiment of the present disclosure. As illustrated in FIG. 1, an image forming apparatus 10 according to the exemplary embodiment may be a so-called electrophotographic image forming apparatus that transfers a desired image (toner image) to a recording medium P made of paper, for example. The image forming apparatus 10 may include an image former 12, a transport unit 14 and a control device 16. FIG. 1 is a view of the principal component of the image forming apparatus 10 as seen from the front, and the following description is given assuming that the width direction is X direction, the depth direction is Y direction, and the height direction is Z direction. In addition, various components included in FIG. 1 are illustrated with their structure simplified.

The image former 12 may be a unit for forming a toner image (an example of an image) on a recording medium P. In order to form a toner image on the recording medium P, the image former 12 may have a toner image former 20, and a transfer device 30.

In order to form a toner image for each color on the outer circumferential surface of the later-described intermediate transfer belt 31 included in the transfer device 30, multiple toner image formers 20 may be provided along the intermediate transfer belt 31 in the transport direction (also referred to as the circumferential direction) RD1. In the present exemplary embodiment, as an example, the toner image formers 20 for a total of four colors of yellow (Y), magenta (M), cyan (C), and black (K) are successively provided from the upstream side in the transport direction of the intermediate transfer belt 31. Note that (Y), (M), (C), (K) illustrated in FIG. 1 indicate components corresponding to the above-mentioned colors. In the following description, when yellow (Y), magenta (M), cyan (C), black (K) need to be distinguished, the symbol of each member is suffixed with (Y), (M), (C), or (K), and when the colors do not need to be distinguished, (Y), (M), (C), and (K) may be omitted. Furthermore, the toner image former 20 of each color can have a similar configuration except for the type of toner, thus only the configuration of the toner image former 20 (Y) representing the toner image former 20 of all the colors will described below. In addition, only the components of the toner image former 20 (Y) are labeled with a symbol in FIG. 1, and symbols for the components of other toner image formers 20 are omitted. Incidentally, of the toner image formers 20, the toner image formers 20 (Y), 20 (M), and the toner image formers 20 (C), 20 (K) have different relative positions with respect to the intermediate transfer belt 31, thus the layouts of the components are slightly different, but the components are common.

As illustrated in FIG. 1, the toner image former 20 (Y) may include a photoconductor drum 22 which rotates in one direction (the counterclockwise in FIG. 1). In addition, a charger 23, an exposure device 24, a developing device 25, and a removal device 26 are successively disposed around the photoconductor drum 22.

The following example may be given as an example of a process of first transfer to the intermediate transfer belt 31 using the photoconductor drum 22. Specifically, first, the photoconductor drum 22 is charged by the charger 23. Subsequently, the photoconductor drum 22 charged by the charger 23 is exposed to light using the exposure device 24 to form an electrostatic latent image on the photoconductor drum 22. When an electrostatic latent image is formed, it is then developed using the developing device 25 to form a toner image. The toner image formed on the photoconductor drum 22 is transferred (first transferred) to the intermediate transfer belt 31 as a yellow image. Finally, the toner remaining on the photoconductor drum 22 surface after the transfer to the intermediate transfer belt 31 is removed by the removal device 26. The toner image former 20 (Y) performs the above-described process at a specific timing, thereby making it possible to transfer the yellow toner image on the intermediate transfer belt 31.

The transfer device 30 may be a device for transferring toner images formed by multiple toner image formers 20 to the recording medium P. Specifically, the transfer device 30 may include an annular intermediate transfer belt (an example of a transfer belt) 31; a drive roller 32 on which the intermediate transfer belt 31 is wound, and which causes the intermediate transfer belt 31 to rotate in a circumferential direction (the clockwise direction in FIG. 1) RD1; multiple support rollers 33 on which the intermediate transfer belt 31 is wound, and which are to support the intermediate transfer belt 31 in a profile (posture) along a desired path; a steering roller 34 that prevents meandering movement and deviation movement of the intermediate transfer belt 31; one to multiple tension rollers 35 that apply tension to the intermediate transfer belt 31; first transfer rollers 36 that bring the intermediate transfer belt 31 into contact with the photoconductor drum 22 of each color to first transfer an image; and a second transfer roller 37 that second transfers an image formed on the intermediate transfer belt 31 to the recording medium P passing through a transfer area TA of the intermediate transfer belt 31, the transfer area TA being formed between the later-described transfer cylinder 50 and the second transfer roller 37. A publicly known configuration may be used as the specific configuration of the above-described several types of rollers. For example, the axial length of each roller may be slightly longer than the width of the intermediate transfer belt 31, and the diameter of the roller may be adjusted as appropriate according to the application. In addition, the above-described several types of rollers may be provided so that their axial directions extend in the depth direction (Y direction) of the image forming apparatus 10. Furthermore, of the above-described multiple rollers, the rollers other than the drive roller 32 may each be comprised of a driven roller not connected to a drive source such as a motor.

The intermediate transfer belt 31 may be comprised of an annular belt member having an outer circumferential surface to which an image is transferred, and more specifically, comprised of an endless belt. The intermediate transfer belt 31 may be disposed so that its width direction extends in the depth direction (Y direction) of the image forming apparatus 10. The intermediate transfer belt 31 may be a belt that comes into contact with the photoconductor drum 22 of the toner image former 20 of each color by the first transfer roller 36, and a toner image is thereby transferred (first transferred) to the belt successively. In addition, the transferred toner image may be transferred (second transferred) to the surface of the recording medium P passing through the transfer area TA which is formed by the intermediate transfer belt 31 coming into contact with the later-described transfer cylinder 50 by the second transfer roller 37.

The rotational axis of the drive roller 32 is connected to a drive roller motor 32M (see FIG. 4) as an example of a drive source. The drive roller 32 receives a driving force from the drive roller motor 32M to rotate, thereby causing the intermediate transfer belt 31 winding on the drive roller 32 to circumferentially rotate in the circumferential direction RD1. The rotational axis of the drive roller 32 may be connected to the drive roller motor 32M via a well-known reducer. The drive roller 32 according to the present exemplary embodiment is disposed to be in contact with the inner circumferential surface of the intermediate transfer belt 31 at a position downstream of the transfer area TA in the transport direction of the intermediate transfer belt 31 and upstream of the toner image former 20 (Y).

The transport unit 14 may perform a series of transports for moving the recording medium P to the transfer position of the image to transfer the image onto the recording medium P, and for discharging the recording medium P with the transferred image to the outside of the image forming apparatus 10. The transport unit 14 may include a transport path 40 along which the recording medium P is transported; a storage section 41 that stores one to multiple recording media P before image formation; a second transfer body 42 which transfers an image to the recording medium P, a fixing device 43 that subsequent to transfer of an image, fixes the image to the recording medium P; and a recording medium detection sensor 44 provided at a position adjacent to the storage section 41 on the transport path 40 to detect the position of the recording medium P by detecting passage of the recording medium P.

The transport path 40 starts at the storage section 41, and allows the recording medium P with an image printed to pass through the transfer area TA, then to pass through between a pair of rollers included in the fixing device 43, and to be discharged to an output tray (not illustrated) provided in the image forming apparatus 10. Multiple rollers (not illustrated) for transport may be disposed along the transport path 40. Although only one tray is illustrated as the storage section 41 in FIG. 1, multiple storage sections 41 may be provided. In the image forming apparatus 1 provided with multiple storage sections 41, respective recording media P stored in the storage sections 41 may differ in the size and material, and the thickness.

Figure 2:
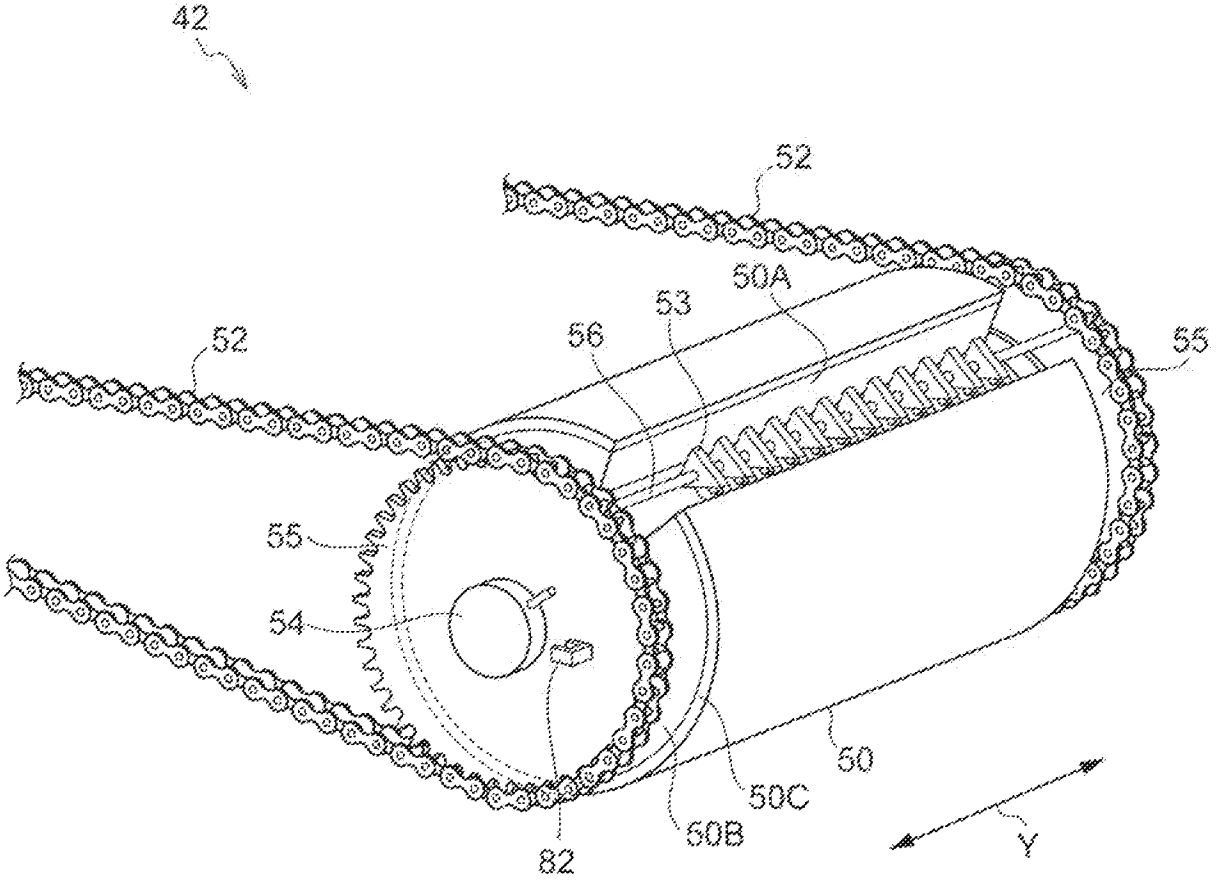
FIG. 2 is an enlarged perspective view illustrating part of a second transfer body of the image forming apparatus illustrated in FIG. 1.

FIG. 2 is an enlarged perspective view illustrating part of the second transfer body of the image forming apparatus according to the first exemplary embodiment of the present disclosure. As illustrated in FIG. 1 and FIG. 2, the second transfer body 42 may be disposed between the storage section 41 and the fixing device 43 on the transport path 40 to transport the recording medium P to the transfer area TA, and transfer an image formed on the intermediate transfer belt 31 to the surface of the recording medium P. The second transfer body 42 may include a transfer cylinder 50 as an example of a transfer roller, a pair of sprockets 51, a pair of chains 52, and a gripper 53.

The transfer cylinder 50 is an example of a transfer roller that forms the transfer area TA between the intermediate transfer belt 31 and itself, and when the recording medium P passes through the transfer area TA, transfers an image formed on the surface of the intermediate transfer belt 31 to the surface of the recording medium P. The transfer area TA formed by the transfer cylinder 50 refers to the area (the area is also referred to as a nip area) where the recording medium P is interposed between the surface of the intermediate transfer belt 31 with the back surface supported by the second transfer roller 37, and the surface of the transfer cylinder 50. The second transfer roller 37, which supports the intermediate transfer belt 31 to bring it into contact with the transfer cylinder 50, may be able to change its position in a direction to be closer to or away from the transfer cylinder 50. When the position of the second transfer roller 37 is changed, mostly the length of the transfer area TA in the circumferential direction RD1 may change. Note that although the above-described transfer cylinder 50 has been illustrated as a transfer roller in the present exemplary embodiment, the transfer roller is not limited to this, and may be a roller that brings the recording medium P into contact with the intermediate transfer belt 31 to perform the second transfer. In relation to this, the image forming apparatus of the present disclosure may not have the below-described other specific components, for example, the gripper 53 and a recess 50A of the second transfer body 42.

The transfer cylinder 50 is fixed to a rotational axis 54. The rotational axis 54 may be connected to a transfer cylinder motor 50M (see FIG. 4) as an example of a drive mechanism, and may receive a driving force from the transfer cylinder motor 50M, and rotate, thereby causing the transfer cylinder 50 to rotate in one direction (hereinafter also referred to as a "rotational direction") RD2, and to circumferentially rotate the pair of chains 52 via the pair of sprockets 51. When the recording medium P is caught by the gripper 53, the recording medium P is transported to the transfer area TA along with the circumferential rotation of the pair of chains 52. The rotational axis 54 of the transfer cylinder 50 may be connected to the transfer cylinder motor 50M via a well-known reducer. Note that although it is illustrated that the transfer cylinder motor 50M is connected to the rotational axis 54 in the present exemplary embodiment, the connection position of the transfer cylinder motor 50M can be changed in a range capable of maintaining its function. Specifically, for example, the transfer cylinder motor 50M may be connected to the pair of sprockets 51 which are rotated in conjunction with the transfer cylinder 50 by the pair of chains 52.

A pair of transfer cylinder-side sprockets 55 may be mounted on axial both ends of the transfer cylinder 50. As illustrated in FIG. 2, the pair of transfer cylinder-side sprockets 55 may be configured to be disposed so as to interpose the transfer cylinder 50 therebetween, and rotate along with the transfer cylinder 50 by being fixed to the rotational axis 54. The outer diameter of the pair of transfer cylinder-side sprockets 55 may be smaller than the outer diameter of the transfer cylinder 50. The pair of chains 52 are wound on the pair of transfer cylinder-side sprockets 55, respectively.

The transfer cylinder 50 may be comprised of a base material 50B, and a surface layer 50C replaceably wound on the outer circumference of the base material 50B. A metal material such as a stainless steel may be used for the base material 50B, and a resin material, such as polyurethane rubber, ethylene propylene rubber (EPM), silicone gum, fluorine rubber (FKM), epichlorohydrin/butadiene rubber may be used for the surface layer 50C. The length of the circumference of the transfer cylinder 50 usable in the exemplary embodiment may be substantially equal to the length of the maximum paper size along the transport direction of the recording medium P usable in the image forming apparatus 10. However, instead of this, the length of the circumference of the transfer cylinder 50 may be shorter than or longer than the length of the recording medium P with the maximum paper size along the transport direction. Furthermore, in the outer circumference of the transfer cylinder 50, the recess 50A is formed which can store the gripper 53 and extends in the axial direction of the transfer cylinder 50. Although only one recess is formed as the transfer cylinder 50 according to the exemplary embodiment, two or more recesses may be formed at intervals.

As with the pair of transfer cylinder-side sprockets 55 connected to the transfer cylinder 50, the pair of chains 52 are wound on the pair of sprockets 51 which may support the pair of chains 52 along with the pair of transfer cylinder-side sprockets 55 in a particular posture. The pair of sprockets 51 are disposed at a position (−X direction relative to the transfer cylinder 50 in FIG. 1) nearer to the fixing device 43 than the transfer cylinder 50. In addition, the pair of sprockets 51 may be rotatably supported integrally on the shaft by the apparatus body (not illustrated) of the image forming apparatus 10.

As illustrated in FIG. 1, the pair of chains 52 are formed to be annular, and may be wound on the pair of sprockets 51 and the pair of transfer cylinder-side sprockets 55. As illustrated in FIG. 2, the pair of chains 52 may be disposed at intervals in the depth direction (Y direction in FIG. 1 and FIG. 2) of the image forming apparatus 10. A configuration is illustrated in which when the transfer cylinder 50 receives a power from the transfer cylinder motor 50M to rotate in the one direction RD2, the pair of chains 52 similarly circumferentially rotate in the one direction (counterclockwise direction in FIG. 1). In order to allow the recording medium P to be easily transported by following the surface of the transfer cylinder 50, the winding angle should be at least 90 degrees or more. In addition, as illustrated in FIG. 2, a mounting member 56 on which the gripper 53 is mounted is bridged over the pair of chains 52 in the depth direction of the image forming apparatus 10. One to multiple pieces of the mounting member 56 are fixed to the pair of chains 52 at predetermined intervals in the circumferential direction of the chains 52.

Figure 3:
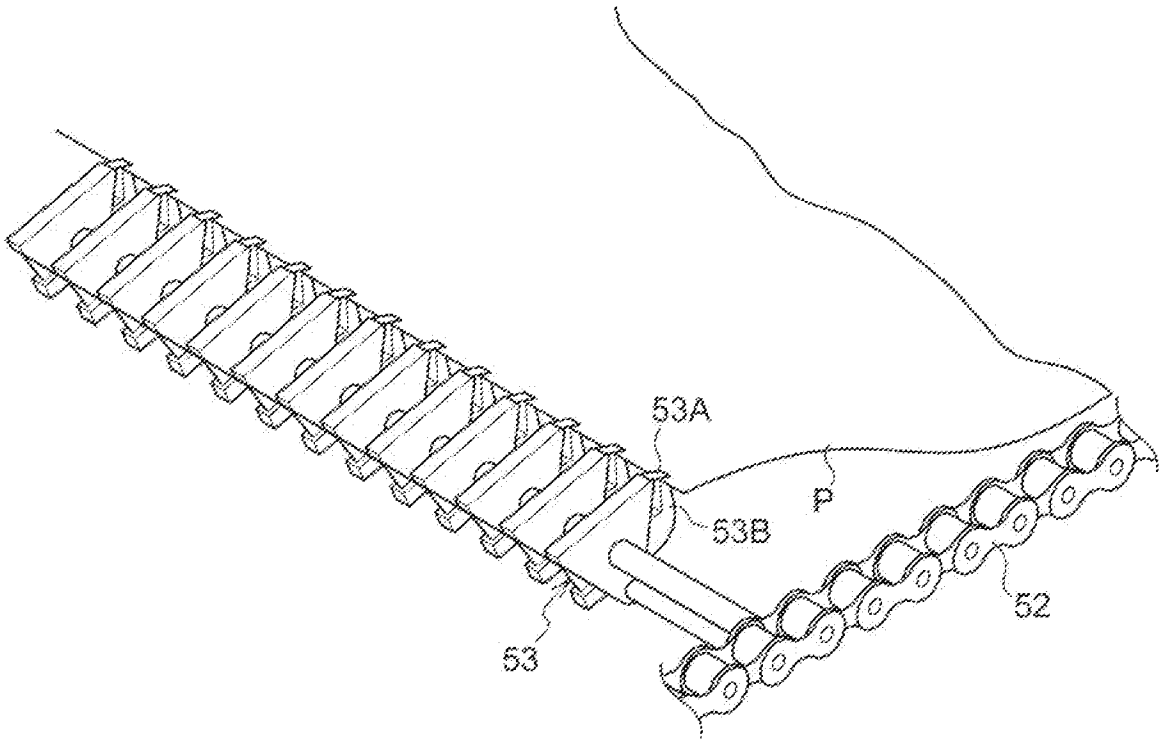
FIG. 3 is an enlarged perspective view illustrating a gripper portion of the second transfer body illustrated in FIG. 2.

FIG. 3 is a further enlarged perspective view illustrating a gripper portion of the second transfer body illustrated in FIG. 2. As illustrated in FIG. 2 and FIG. 3, multiple grippers 53 may be mounted on the mounting member 56 at predetermined intervals in the depth direction of the image forming apparatus 10. In other words, each gripper 53 may be mounted to the chains 52 via the mounting member 56. The gripper 53 is an example of a holding member that has a function of holding the front edge of the recording medium P in the transport direction. Specifically, as illustrated in FIG. 3, each gripper 53 has a nail 53A and a nail stand 53B. The gripper 53 can hold the recording medium P by pinching the front edge of the recording medium P between the nail 53A and the nail stand 53B. The gripper 53 holds the front edge other than an image area of the recording medium P, where the image area is the area to which a toner image is transferred. The gripper 76 can hold the recording medium P by a configuration in which, for example, the nail 53A is pressed against the nail stand 53B by a spring or the like, as well as the nail 53A is opened or closed to the nail stand 53B by an operation of a cam or the like.

By the above-described series of configurations, the transport operation is performed in the transport unit 14 as follows. Specifically, the recording medium P is first delivered to the transport path 40 from the storage section 41 by a transport roller or the like (not illustrated). Subsequently, when the recording medium P reaches a part on the transport path 40, where the second transfer body 42 is disposed, the front edge of the recording medium P is held by the gripper 53. The gripper 53 holding the front edge of the recording medium P is further moved on the transport path 40 along with the circumferential rotation of chains 52, then the gripper 53 is stored in the recess 50A of the transfer cylinder 50. The gripper 53 stored in the recess 50A further transports the recording medium P along with the rotational movement of the transfer cylinder 50, and the recording medium P passes through the transfer area TA while being held by the gripper 53. After passing through the transfer area TA, the recording medium P is transported to the fixing device 43, and transferred toner images are fixed. The recording medium P with the toner images fixed is discharged to an output tray (not illustrated) provided at an appropriate position of the image forming apparatus 10.

The control device 16 may function as a controller that controls a series of operations in the image forming apparatus 10. In addition, the control device 16 may be comprised of a well-known computer, for example. Here, a well-known computer may include at least a volatile or nonvolatile memory (for example, a random access memory (RAM) and a hard disk drive (HDD)), and a processor represented by a central processing unit (CPU). In relation to this, various types of operations of the control device 16 described below can be provided in the form of a program stored in a memory or in the form of a non-transitory computer-readable medium.

Figure 4:
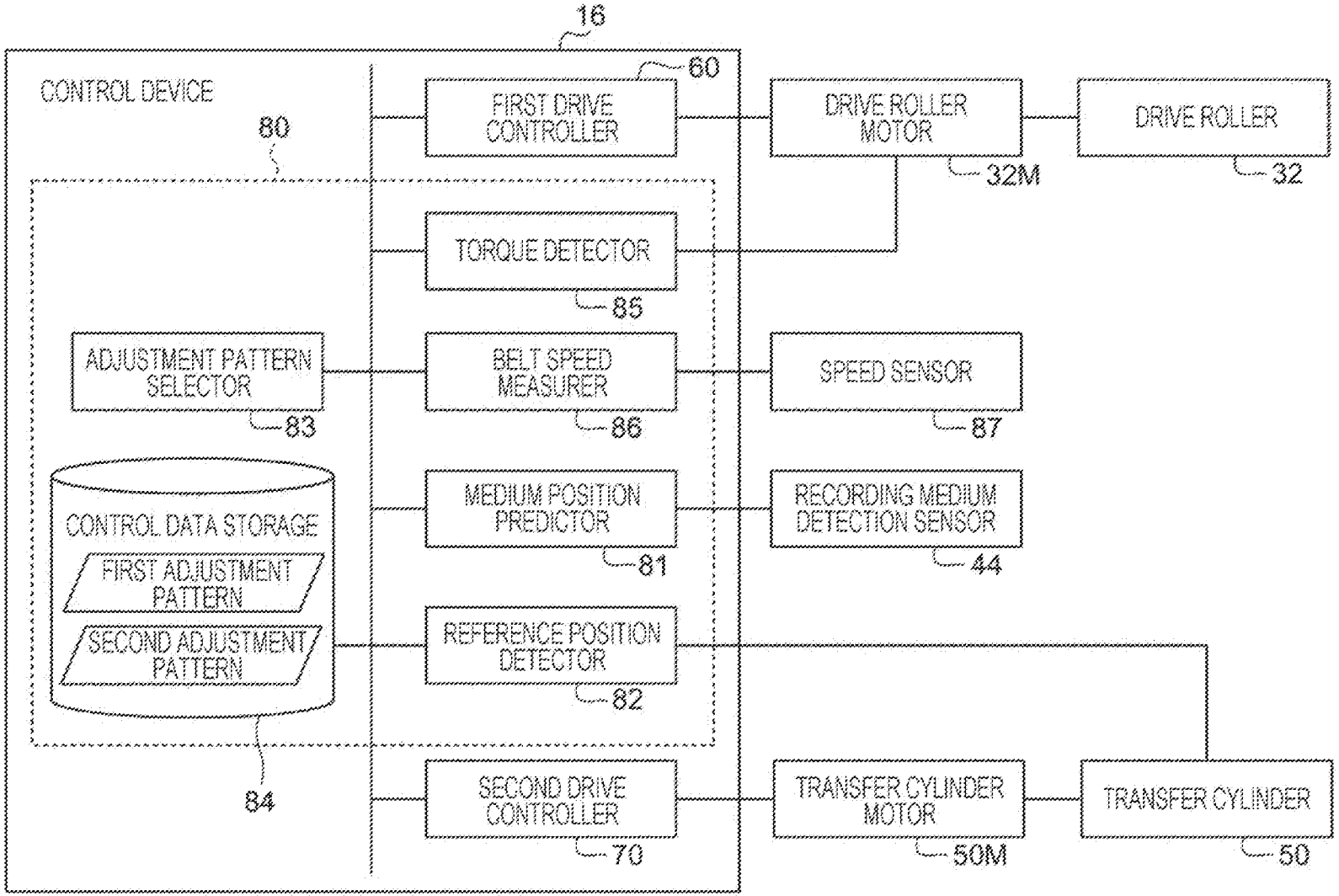
FIG. 4 is a functional block diagram illustrating an example of a control device of the image forming apparatus illustrated in FIG. 1.
Figure 5A:
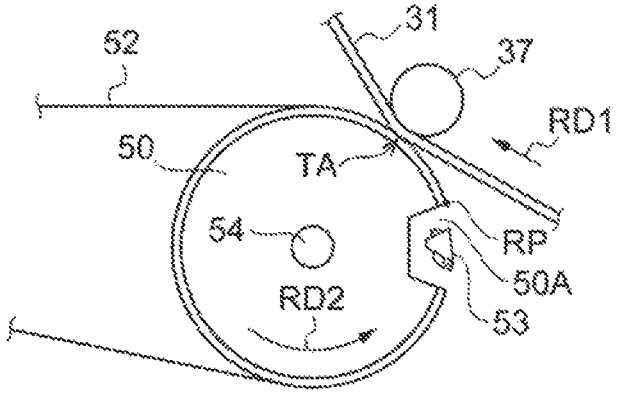
FIGS. 5A to 5C are each an operation explanatory diagram of a transfer area portion of the image forming apparatus illustrated in FIG. 1.
Figure 5B:
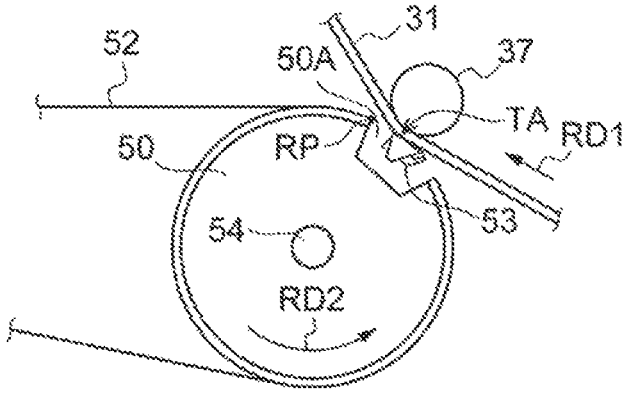
Figure 5C:
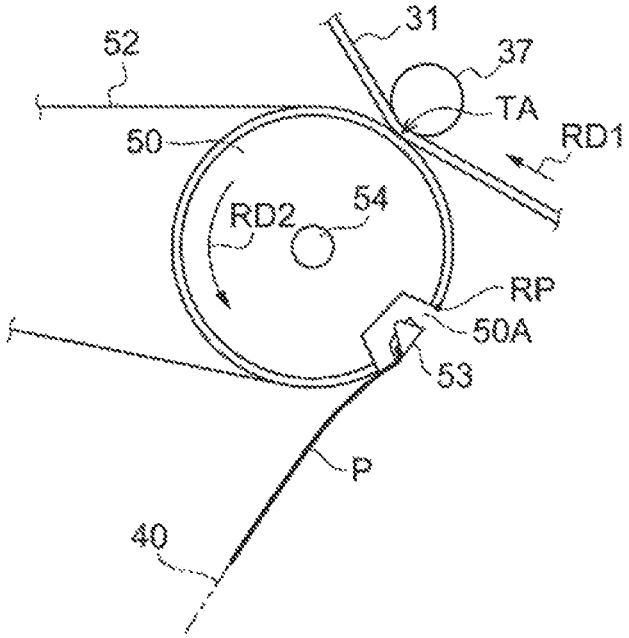
Figure 6A:
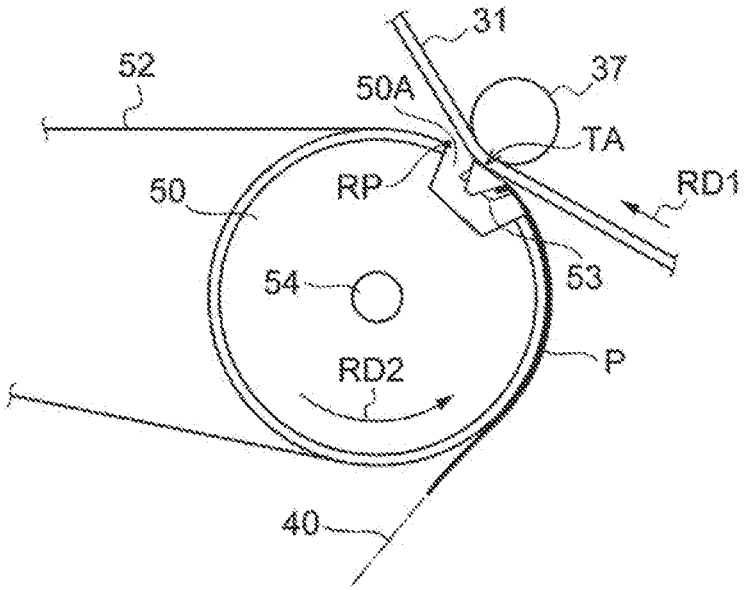
FIGS. 6A and 6B are each an operation explanatory diagram of a transfer area portion of the image forming apparatus illustrated in FIG. 1.
Figure 6B:
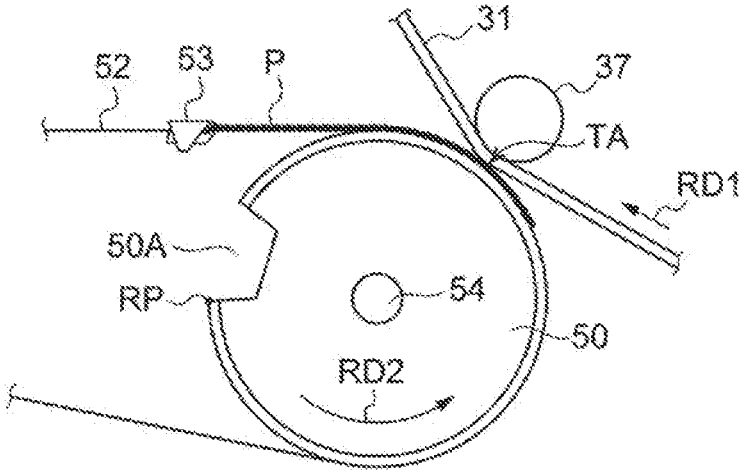

FIG. 4 is a functional block diagram illustrating an example of the control device illustrated in FIG. 1. In FIG. 4, of various types of functions of the control device 16, only the functions related to speed control of the image former 12 and the transport unit 14 are shown, and a description of a configuration to implement other functions is omitted. As illustrated in FIG. 4, the control device 16 may include a first drive controller 60 that operates the drive roller motor 32M, a second drive controller 70 that operates the transfer cylinder motor 50M, and a speed adjustment mechanism 80 that adjusts the rotational speed of the transfer cylinder motor 50M.

The first drive controller 60 may be comprised of a driver that outputs a drive signal to the drive roller motor 32M based on a received control pulse signal. It is possible to use a motor, for example, an AC servo motor or a stepping motor as the drive roller motor 32M that operates based on the drive signal from the first drive controller 60, the motor being capable of measuring the load torque and controlling the speed with high accuracy. After receiving a drive signal from the first drive controller 60, the drive roller motor 32M may operate in a speed control mode in which the drive roller 32 is rotated at a specific target rotational speed, and may circumferentially rotate the intermediate transfer belt 31 in the circumferential direction RD1.

The second drive controller 70 may be comprised of a driver that outputs a drive signal to the transfer cylinder motor 50M based on a received control pulse signal. It is possible to use a motor, for example, an AC servo motor or a stepping motor as the transfer cylinder motor 50M that operates based on the drive signal from the second drive controller 70, the motor being capable of measuring the load torque and controlling the speed with high accuracy. After receiving a drive signal from the second drive controller 70, the transfer cylinder motor 50M rotates the rotational axis 54 at a specific rotational speed, and rotates the transfer cylinder 50 in the rotational direction RD2. The second drive controller 70 and the transfer cylinder motor 50M are each an example of a drive mechanism.

As described above, in the image forming apparatus 10 according to the present exemplary embodiment, the intermediate transfer belt 31 is circumferentially moved in the circumferential direction RD1 by rotating the drive roller 32 by the drive roller motor 32M, and the transfer cylinder 50 is rotated by the transfer cylinder motor 50M. The circumferentially moving intermediate transfer belt 31 and the rotating transfer cylinder 50 come into direct or indirect contact with each other at the transfer area TA, thus the speed of the circumferential movement of the intermediate transfer belt 31 may be affected by not only the rotational speed of the drive roller 32 but also the rotational speed of the transfer cylinder 50. Specifically, for example, when the rotational speed of the drive roller 32 is lower than the rotational speed of the transfer cylinder 50, at least part of the torque of the transfer cylinder 50 acts to increase the circumferential movement speed (in other words, act as an accelerator) of the intermediate transfer belt 31 through the transfer area TA. Conversely, when the rotational speed of the drive roller 32 is higher than the rotational speed of the transfer cylinder 50, at least part of the torque of the transfer cylinder 50 acts to decrease the circumferential movement speed (in other words, act as a brake) of the intermediate transfer belt 31 through the transfer area TA. In this manner, an action due to the load from the transfer cylinder 50 triggered by the speed difference between the circumferential speed of the intermediate transfer belt 31 and the rotational speed of the transfer cylinder 50 may cause a variation in the circumferential speed of the intermediate transfer belt 31 and expansion and contraction of the intermediate transfer belt 31 itself. Such an unexpected variation in the circumferential speed of or expansion and contraction of the intermediate transfer belt 31 may cause banding (streak of lines extending in a direction crossing the transport direction of the intermediate transfer belt 31, and an image density unevenness) and misalignment of color registration (positioning of the image of each color).

In addition, the value of the torque of the drive roller motor 32M necessary for the intermediate transfer belt 31 to circumferentially move at a specific speed varies with the operational state of the image forming apparatus 10. Specifically, the torque value required for the drive roller motor 32M differs between two states: one state in which the recording medium P is passing through the transfer area TA, and the other state in which the recording medium P is not passing through the transfer area TA. It is presumed that this is caused by at least one of variation in amount of bite, variation in frictional force, and an electrostatic adsorption force, the variation in amount of bite being into at least one of the second transfer roller 37 and the transfer cylinder 50 and associated with the passage of the recording medium P, the variation in frictional force being due to change of the object in contact with the intermediate transfer belt 31 at the transfer area TA from the transfer cylinder 50 to the recording medium P (or from the recording medium P to the transfer cylinder 50), the electrostatic adsorption force being generated between the second transfer roller 37 and the transfer cylinder 50 by a transfer bias current applied to the second transfer roller 37 to transfer a toner image to the recording medium P.

In the image forming apparatus 10 according to the present exemplary embodiment, in consideration of the above-described points, the speed adjustment mechanism 80 is used to eliminate the speed difference between the circumferential speed of the intermediate transfer belt 31 and the rotational speed of the transfer cylinder 50.

The speed adjustment mechanism 80 adjusts the rotational speed of the transfer cylinder 50 by selectively using the below-described two different adjustment patterns based on the transport position of the recording medium P. The rotational speed of the transfer cylinder 50 adjusted by the speed adjustment mechanism 80 can function to eliminate the speed difference between the circumferential speed of the intermediate transfer belt 31 and the rotational speed of the transfer cylinder 50. As illustrated in FIG. 4, the speed adjustment mechanism 80 may include at least medium position predictor 81, a reference position detector 82, an adjustment pattern selector 83, and a control data storage 84.

The medium position predictor 81 may predict the position of the recording medium P transported on the transport path 40. The medium position predictor 81 is illustrated which predicts the timing when a state in which the transfer cylinder 50 transports the recording medium P is assumed by specifically predicting the timing when the transport of the recording medium P by the transfer cylinder 50 is started, and the timing when the transport of the recording medium P by the transfer cylinder 50 is completed. The medium position predictor 81 may be connected to the recording medium detection sensor 44. The medium position predictor 81 can predict the position of the recording medium P transported along the transport path 40 with high accuracy by taking the following into consideration: the result of detection by the recording medium detection sensor 44, and in addition, the circumferential speed of the pair of chains 52 and the details of operational instructions obtained by the control device 16, specifically, execution or non-execution of duplex printing.

The reference position detector 82 may identify the cycle of the transfer cylinder 50 by detecting a specific position as a reference in the transfer cylinder 50. As the reference position detector 82, for example, a photo sensor (see FIG. 2) may be used which detects passage of an actuator mounted on the rotational axis 54, for example. The above-mentioned specific position as a reference is not particularly limited. However, in the present exemplary embodiment, in order to facilitate the understanding, the position immediately before the recess is provisionally defined as the reference position RP (see FIG. 1), and one cycle of the transfer cylinder 50 is provisionally defined as the time since the reference position RP passes through the transfer area TA until the reference position RP reaches the transfer area TA again.

The adjustment pattern selector 83 may select an adjustment pattern to be used for control of the transfer cylinder 50 based on the position of the recording medium P predicted by the medium position predictor 81, more specifically, based on whether the recording medium P is transported at the predicted position by the transfer cylinder 50. The adjustment pattern may be selected in units of the cycle detected by the reference position detector 82. Here, what is meant by that the adjustment pattern is selected and applied "in units of the cycle" is that the adjustment pattern is selected and applied every cycle of the transfer cylinder 50, or every two or more specific cycles. In addition, the adjustment pattern selector 83 generates a control pulse signal based on the selected adjustment pattern, and transmits the generated control pulse signal to the second drive controller 70, and may use a system called an electronic cam in general.

The control data storage 84 may be comprised of a recording medium capable of storing various data necessary to make rotational speed adjustment of the transfer cylinder 50. The control data storage 84 may store at least control data corresponding to the first adjustment pattern and the second adjustment pattern. Here, the "adjustment pattern" refers to control information for rotating the transfer cylinder 50, and is called "cam data" in the electronic cam.

The first adjustment pattern includes control information (hereinafter also referred to as "adjustment pattern data") for adjusting the rotational speed of the transfer cylinder 50 in a cycle including at least a state in which the transfer cylinder 50 transports the recording medium P. The control information included in the first adjustment pattern may be identified in advance by an experiment or the like. The rotational speed in the first adjustment pattern may be set for rotation at a constant speed value during a particular cycle, or may be set for changing the speed value at a specific timing during a cycle.

The second adjustment pattern is different from the first adjustment pattern, and includes control information for adjusting the rotational speed of the transfer cylinder 50. The second adjustment pattern may be applied to adjustment of the number of rotations in a cycle not including a state in which the transfer cylinder 50 transports the recording medium P. Here, the cycle not including a state in which the transfer cylinder 50 transports the recording medium P refers to, for example, the following cycles: a cycle corresponding to a timing when only the first transfer operation is performed by the image former 12, and a cycle corresponding to a timing when image quality adjustment is made while allowing the intermediate transfer belt 31 to move.

FIGS. 5A to 5C and FIGS. 6A and 6B are each an operation explanatory diagram of a transfer area portion of the image forming apparatus illustrated in FIG. 1. In FIGS. 5A to 5C and FIGS. 6A and 6B, a portion corresponding to the transfer area TA is illustrated with a large scale. Hereinafter, a technique of speed adjustment by the speed adjustment mechanism 80 including the above-described configuration will be illustrated with reference to FIGS. 5A to 5C and FIGS. 6A and 6B. In the description shown below, the adjustment pattern selector 83 is illustrated which can change the adjustment pattern for the rotational speed of the transfer cylinder 50 every cycle, in other words, can change the adjustment pattern every time the reference position RP passes through the transfer area TA. As the recording medium P to which an image is transferred, such a recording medium is illustrated whose length in the transport direction is shorter than the length of the circumference of the transfer cylinder 50 (see FIG. 6).

First, when the power supply for the image forming apparatus 10 is turned on, a transfer operation of an image to the recording medium P is started triggered by, for example, an operation performed by an operator on a user interface (for example, a touch panel or a button) of the image forming apparatus 10, or reception of an operational instruction transmitted via a network from a client computer or the like. Then in the image forming apparatus 10, image formation by the toner image former 20 of each color is started, and a first transfer operation on an image of each color to the intermediate transfer belt 31 is started. The rotational movement of the transfer cylinder 50 may begin concurrently with the start of the above-mentioned first transfer operation, or may begin preceding the start (see FIGS. 5A and 5B). The rotational movement of the transfer cylinder 50 may be performed in such a manner that the adjustment pattern selector 83 selects the second adjustment pattern, and transmits a control pulse signal adjusted based on the second adjustment pattern to the second drive controller 70.

Next, when transport of the recording medium P from the storage section 41 is started, and passage of the recording medium P is detected by the recording medium detection sensor 44, after elapse of a specific waiting time, the medium position predictor 81 selects the first adjustment pattern, and generates a control pulse signal adjusted based on the first adjustment pattern (or proceeds to control using the first cam data). The control pulse signal generated here is transmitted to the second drive controller 70 so that adjustment of the rotational speed of the transfer cylinder 50 by the first adjustment pattern is started at the timing right before the transfer cylinder 50 starts transfer to the recording medium P, for example, the timing when a cycle of the transfer cylinder 50 is reached, the cycle including the timing when the transfer cylinder 50 starts transport of the recording medium P (see FIG. 5C).

The recording medium P is transported to the transfer cylinder 50 with the rotational speed adjusted by the first adjustment pattern, and passes through the transfer area TA (see FIGS. 6A and 6B), thus an image formed on the intermediate transfer belt 31 is transferred to the surface of the recording medium P. In the transfer cylinder 50, even after the recording medium P has passed through the transfer area TA, adjustment of the rotational speed by the first adjustment pattern is continued until the reference position RP passes through the transfer area TA again.

In order to identify the adjustment pattern for the rotational speed of the transfer cylinder 50 in a cycle after the reference position RP of the transfer cylinder 50 reaches the transfer area TA again, the adjustment pattern selector 83 selects an adjustment pattern based on whether transport of a new recording medium P has started by the transfer cylinder 50, based on the output of the medium position predictor 81. Specifically, when the subsequent cycle includes a timing to start transport of a new recording medium P, the adjustment pattern selector 83 continues the adjustment of the rotational speed based on the first adjustment pattern, and when the subsequent cycle does not include a timing to start transport of a new recording medium P, the adjustment pattern selector 83 generates a control pulse signal in order to change to the adjustment of the rotational speed based on the second adjustment pattern (or proceeds to control using the second cam data).

As described above, in a cycle including a state in which the transfer cylinder 50 transports the recording medium P, the speed adjustment mechanism 80 according to the present exemplary embodiment can cause the transfer cylinder 50 to move at the rotational speed adjusted based on the first adjustment pattern, and in other cycles, the speed adjustment mechanism 80 can cause the transfer cylinder 50 to move at the rotational speed adjusted based on the second adjustment pattern. Thus, the adjustment pattern for the rotational speed of the transfer cylinder 50 can be changed depending on whether the recording medium P passes through the transfer area without requiring an operation by an operator. Therefore, it is possible to prepare the first adjustment pattern corresponding to an optimal rotational speed of the transfer cylinder 50 at the timing when the recording medium P passes through the transfer area TA. Thus, distortion of an image transferred to the recording medium P can be prevented, as compared with when the transfer cylinder 50 is controlled in drive without considering whether the transfer cylinder 50 transports the recording medium P.

As an option, in addition to the above-described components, the speed adjustment mechanism 80 may include a torque detector 85 that detects the torque of the drive roller 32, in other words, the torque of the drive roller motor 32M. The torque detector 85 may detect the torque value of the drive roller motor 32M directly from the drive roller motor 32M or via a servo amplifier (not illustrated) provided separately from the drive roller motor 32M. The torque value detected by the torque detector 85 may be used to generate the above-described first and second adjustment pattern data.

In the present exemplary embodiment, the drive roller motor 32M operates in the speed control mode in which the drive roller 32 is rotated at a specific target rotational speed. Thus, a strong correlation is observed between the current value supplied to the drive roller motor 32M and the torque value of the drive roller motor 32M. As another option, in addition to the above-described components, the speed adjustment mechanism 80 may use a current value detector (not illustrated) that detects the current value supplied to the drive roller motor 32M. As with the torque value detected by the above-described torque detector 85, the current value detected by the current value detector can also be used to generate the above-described first and second adjustment pattern data. The current value detector may be used instead of the torque detector 85 or in addition to the torque detector 85.

As another option, in addition to the above-described components, the speed adjustment mechanism 80 may further include a belt speed measurer 86 that can measure the circumferential speed of the intermediate transfer belt 31. The belt speed measurer 86 may be connected to a speed sensor 87 provided in a support roller 33A (see FIG. 1) disposed downstream in the circumferential direction RD1 of the intermediate transfer belt 31 with respect to the position where one of multiple rollers 33 that support the intermediate transfer belt 31 is disposed, specifically, the toner image former 20 (K) for black (K) is disposed, for example. Note that the mounting position of the speed sensor 87 is not limited to this, and may be another position as long as the position allows the speed of the intermediate transfer belt 31 to be measured. As with the torque value detected by the above-described torque detector 85 and the current value detected by the current value detector, the circumferential speed of the intermediate transfer belt 31 measured by the belt speed measurer 86 can also be used to generate the above-described first and second adjustment pattern data.

In the above-described first exemplary embodiment, the control information included in the first and second adjustment patterns has been illustrated which is formed of any predetermined values; however, the present disclosure is not limited to this. Specifically, the control information included in each adjustment pattern may be continuously changed to an appropriate value by using, for example, at least one of the torque detector 85, the current value detector and the belt speed measurer 86 described above, and utilizing these detection results and measurement result (specifically, at least of the torque variation of the drive roller 32, the current value supplied to the drive roller motor 32M and movement speed of the intermediate transfer belt 31). In other words, the control information including various types of parameters included in each adjustment pattern may be capable of being updated to appropriate information during the operation of the image forming apparatus 10. Thus, an optimal adjustment result may be obtained continuously by applying each adjustment pattern. In addition, it is also possible to cope with a difference in the optimal adjustment pattern caused by a difference in the individual difference of the surface layer 50C of the transfer cylinder 50, in the operation environment of the image forming apparatus 10, and in the type of the recording medium P used, for example. Furthermore, it is also possible to reduce the frequency of maintenance for change (fine adjustment) of the control information included in the adjustment pattern.

In the above-described exemplary embodiment, the speed adjustment mechanism 80 changes the rotational speed of the transfer cylinder 50 by switching between two different adjustment patterns, and executing one of them. When the rotational speed of the transfer cylinder 50 is changed, even if the amount of change is very small (for example, around 0.1%), the change can have an effect (as an accelerator or a brake) on the circumferential speed of the intermediate transfer belt 31 or the rotational speed of the drive roller 32. Thus, in the first and second adjustment patterns selected by the speed adjustment mechanism 80 according to the present exemplary embodiment, the timing to change the rotational speed may be set to the moment when the recess 50A passes through the transfer area TA. At the timing when the recess 50A passes through the transfer area TA, the transfer cylinder 50 and the intermediate transfer belt 31 are in a non-contact state, thus it is possible to prevent an effect on the speed of intermediate transfer belt 31.

In the above-described exemplary embodiment, the rotational speed of the transfer cylinder 50 is adjusted to reduce the speed difference between the circumferential speed of the intermediate transfer belt 31 and the rotational speed of the transfer cylinder 50. Specifically, the rotational speed is changed by switching between and executing one of the two different adjustment patterns in units of the cycle. When the rotational speed is changed in units of the cycle, the timing when the recess 50A passes through the transfer area TA, in other words, the timing when the transported recording medium P starts to pass through the transfer area TA is not constant. In order to reduce such a deviation in the timing, when the torque value of the drive roller motor 32M at the time of passage of the portion other than the recess 50A of the transfer cylinder 50 through the transfer area TA is higher than the torque value at the time of passage of the recess 50A through the transfer area TA, the torque is decreased by increasing the speed of the transfer cylinder 50 when passing through the transfer area TA, thus the speed adjustment mechanism 80 may adjust the rotational speed of the transfer cylinder 50 at the time of passage of the recess 50A through the transfer area TA to be relatively lower. When the torque value of the drive roller motor 32M at the time of passage of the portion other than the recess 50A of the transfer cylinder 50 through the transfer area TA is lower than the torque value at the time of passage of the recess 50A through the transfer area TA, the torque is increased by decreasing the speed of the transfer cylinder 50 when passing through the transfer area TA, thus the speed adjustment mechanism 80 may adjust the rotational speed of the transfer cylinder 50 at the time of passage of the recess 50A through the transfer area TA to be relatively higher.

In addition, in the image forming apparatus 10, the timing of formation of images on the intermediate transfer belt 31, in other words, the interval (pitch) between images formed on the intermediate transfer belt 31 is adjusted to correspond to the timing when the recording medium P passes through the transfer area TA. Thus, when the timing when the recording medium P passes through the transfer area TA is not constant, the operation timing of the toner image former 20 of each color needs to be adjusted to correspond to the timing when the current recording medium P passes through the transfer area TA. Thus, in the speed adjustment mechanism 80 according to the present exemplary embodiment, in consideration of the above-described points, even when either one of the first and second adjustment patterns is applied, it is desirable to achieve a matched average value of the rotational speed in each cycle of the transfer cylinder 50.

Figures 7A, 7B, 7C:
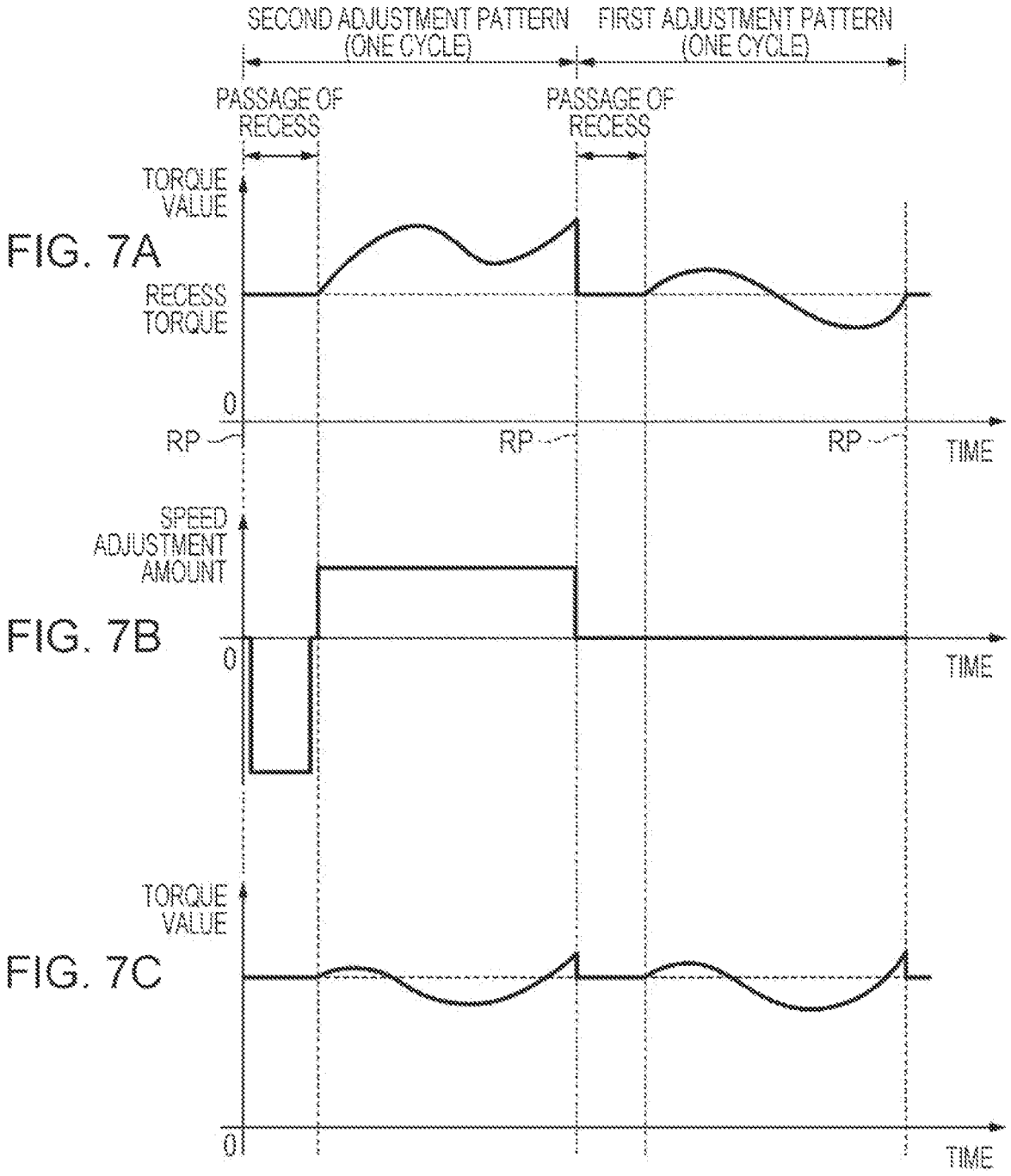
FIGS. 7A to 7C are each an example of a result of adjustment made by a speed adjustment mechanism in the image forming apparatus illustrated in FIG. 1.

FIGS. 7A to 7C are each an example of a result of adjustment made by the speed adjustment mechanism in the image forming apparatus illustrated in FIG. 1, FIG. 7A is a graph illustrating a variation in the torque value of the drive roller before adjustment is made by the speed adjustment mechanism, FIG. 7B is a graph illustrating a variation in the amount of speed adjustment to the transfer cylinder for which adjustment is made by the speed adjustment mechanism, and FIG. 7C is a graph illustrating a variation in the torque value of the drive roller after adjustment is made by the speed adjustment mechanism. In FIGS. 7A and 7C, the horizontal axis indicates time, and the vertical axis indicates variation in the torque value of the drive roller motor 32M. In contrast, in FIG. 7B, the horizontal axis indicates time, and the vertical axis indicates amount of adjustment to the rotational speed of the transfer cylinder 50. In addition, FIGS. 7A to 7C illustrate variation in the rotational speed in two cycles in which change is made from the state in which the second adjustment pattern is applied to the state in which the first adjustment pattern is applied. Here, an adjustment value for the rotational speed of the transfer cylinder 50 is set to achieve a specific value of the average speed of the transfer cylinder by measurement in advance so that the torque average value of the drive roller motor 32M when the recess 50A passes through the transfer area TA is substantially equal to the torque average value of the drive roller motor 32M when the portion other than the recess 50A passes through the transfer area TA. It is assumed that the torque value of the drive roller motor 32M when the rotational speed of the transfer cylinder is not adjusted is as illustrated in FIG. 7A. The speed adjustment mechanism 80 adjusts the rotational speed of the transfer cylinder 50, thereby setting an adjustment value for the rotational speed of the transfer cylinder 50 to achieve the values as illustrated in FIG. 7C in which the torque variation of the drive roller motor 32M in units of the cycle is approximately uniform. In this case, for example, the torque variation of the drive roller motor 32M in units of the cycle should be adjusted using the speed adjustment value as illustrated in FIG. 7B. In FIG. 7C, the vertical axis indicates torque value; however, the circumferential speed of the intermediate transfer belt 31 may be used instead of the torque value. In other words, the rotational speed of the transfer cylinder 50 may be adjusted by the speed adjustment mechanism 80 so that the circumferential speed of the intermediate transfer belt 31 in units of the cycle is substantially uniform.

In order to achieve the above-mentioned matched average value of the rotational speed in one cycle of the transfer cylinder 50, it is determined whether the average value of the speed at the time of passage of the portion other than the recess 50A of the transfer cylinder 50 through the transfer area TA matches a predetermined specific value. When the average value of the speed at the time of passage of the portion other than the recess 50A of the transfer cylinder 50 through the transfer area TA is lower than the specific value, the speed at the time of passage of the recess 50A through the transfer area TA is increased, and the control information for an applied adjustment pattern is set so that the average speed value in the one cycle matches the specific value. Conversely, when the average value of the speed at the time of passage of the portion other than the recess 50A of the transfer cylinder 50 through the transfer area TA is higher than the specific value, the speed at the time of passage of the recess 50A through the transfer area TA is decreased (see, for example, the variation in the speed adjustment value in one cycle to which the second adjustment pattern is applied in FIG. 7B), and the control information for an applied adjustment pattern is set so that the average speed value in the one cycle matches the specific value. When the average value of the rotational speed in one cycle of the transfer cylinder 50 matches the specific value, the control information for an applied adjustment pattern may be set so that the speed at the time of passage of the recess 50A through the transfer area TA matches the speed at the time of passage of the portion other than the recess 50A through the transfer area TA (see, for example, the speed change in one cycle to which the first adjustment pattern is applied in FIGS. 7A to 7C). When the timing of change in the rotational speed of the transfer cylinder 50 is the time of passage of the recess 50A through the transfer area TA as illustrated in FIG. 7B, the speed change of the transfer cylinder 50 does not affect the intermediate transfer belt 31.

As described above, when the average value of the rotational speed of the transfer cylinder 50 with the first and second adjustment patterns applied is matched with the specific value by changing the speed at the time of passage of the recess 50A through the transfer area TA, the interval between images formed on the intermediate transfer belt 31 can be made constant. Consequently, it is not necessary to successively check the timing when the recording medium P passes through the transfer area TA. When an image is formed on the intermediate transfer belt 31, various types of image quality adjustment are easily applied.

Figures 8A, 8B:
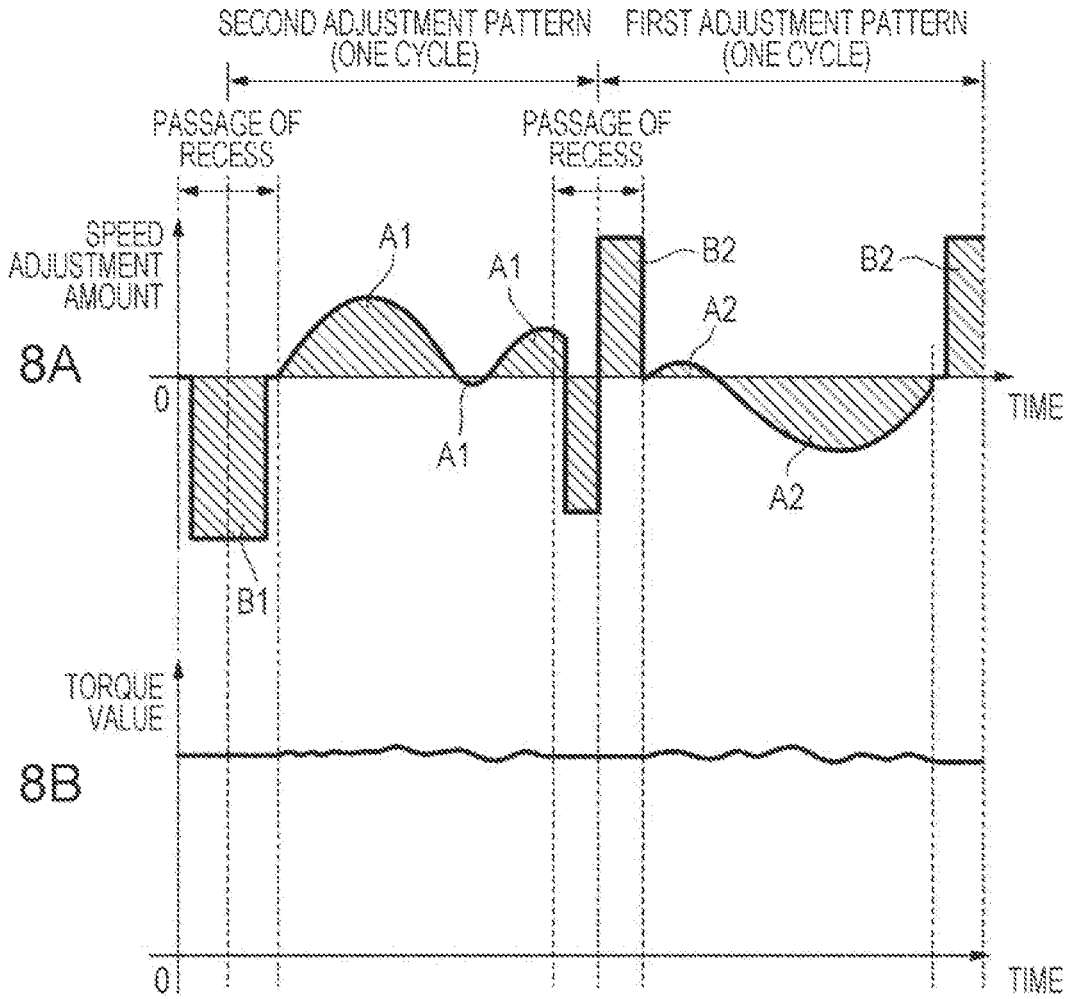
FIGS. 8A and 8B are each another example of a result of adjustment made by the speed adjustment mechanism in the image forming apparatus illustrated in FIG. 1.

FIGS. 8A and 8B are each another example of a result of adjustment made by the speed adjustment mechanism in the image forming apparatus illustrated in FIG. 1, FIG. 8A is a graph illustrating a variation in the amount of speed adjustment to the transfer cylinder for which adjustment is made by the speed adjustment mechanism, and FIG. 8B is a graph illustrating a variation in the torque value of the drive roller after adjustment is made by the speed adjustment mechanism. In FIGS. 8A and 8B, the vertical axis and the horizontal axis correspond to those in FIGS. 7A and 7B described above. An example has been illustrated in which the rotational speed when the portion other than the recess 50A passes through the transfer area TA is made constant by the control of the rotational speed illustrated in FIGS. 7A to 7C; however, the present disclosure is not limited to this. Specifically, as illustrated in FIG. 8A, the rotational speed at the time of passage of the portion other than the recess 50A through the transfer area TA may be continuously varied. However, even when the rotational speed at the time of passage of the portion other than the recess 50A through the transfer area TA is continuously varied, as with the average speed value in other cycles, the average value of the rotational speed of the transfer cylinder 50 in one cycle is controlled to match a specific value. As a specific method, as illustrated in FIG. 8A, the rotational speed at the time of passage of the recess 50A of the transfer cylinder 50 through the transfer area TA may be adjusted so that the total of the areas A1 and A2 surrounded by the line indicating variation in the rotational speed at the time of passage of the portion other than the recess 50A of the transfer cylinder 50 through the transfer area TA, and the line indicating the zero value of the speed adjustment amount is equal to the total of the areas B1 and B2 surrounded by the line indicating variation in the rotational speed at the time of passage of the recess 50A of the transfer cylinder 50 through the transfer area TA, and the line indicating the zero value of the speed adjustment amount. Thus, even when the rotational speed at the time of passage of the portion other than the recess 50A through the transfer area TA is not constant, the interval between images formed on the intermediate transfer belt 31 can be made constant.

As a modification, when the image forming apparatus 10 according to the present exemplary embodiment is a type of image forming apparatus having multiple storage sections 41 storing different recording media P, the first and second control patterns to be executed by the speed adjustment mechanism 80 may include multiple adjustment patterns which are set corresponding to the multiple storage sections 41. In this manner, multiple different adjustment patterns are prepared in advance as the first and second adjustment patterns for each of multiple storage sections 41, that is, for each of recording media P to be used, and one adjustment pattern corresponding to the storage section 41 which stores the recording medium P transported on the transport path 40 is selected and executed as the first and second adjustment patterns. Then, even when the amount of adjustment to an optimal rotational speed is changed due to, for example, a difference in the transfer current setting value for each recording medium P, it is possible to change to the amount of adjustment to an optimal rotational speed. In order to select one adjustment pattern from the multiple adjustment patterns, a correspondence relationship with the multiple adjustment patterns mentioned above may set in part of setting parameters of each storage section, for example. When switching between the adjustment patterns is performed in this manner according to the recording medium P which passes through the transfer area TA, even in the image forming apparatus in which the recording media P with different types (specifically, size and material, thickness) are selectively used, distortion of an image transferred to the recording medium P can be prevented, The present disclosure is not limited to the above-described exemplary embodiment, and may be changed and implemented in various manners within a scope not departing from the spirit of the present disclosure. Those changed embodiments are all included in the technical idea of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an annular transfer belt to which an image is transferred;

a transfer roller that transfers the image to a recording medium when the recording medium passes through a transfer area which is formed between the transfer roller and the transfer belt;

a drive mechanism that causes the transfer roller to rotate; and a speed adjustment mechanism that adjusts a rotational speed of the transfer roller in units of a cycle of the transfer roller, and switchably executes one of a first adjustment pattern and a second adjustment pattern in a cycle including a state in which the transfer roller transports the recording medium, the rotational speed being achieved by the drive mechanism, the first adjustment pattern for adjusting the rotational speed of the transfer roller, the second adjustment pattern for adjusting the rotational speed of the transfer roller by a pattern different from the first adjustment pattern.

2. The image forming apparatus according to claim 1, further comprising:

a holding member that holds the recording medium, and causes the recording medium to pass through the transfer area, wherein the transfer roller includes a recess on a circumferential surface, the recess being configured to store the holding member, and when an average value of the rotational speed of the transfer roller at a time of passage of a portion other than the recess of the transfer roller through the transfer area is lower than a specific value, the speed adjustment mechanism adjusts the rotational speed of the transfer roller at a time of passage of the recess through the transfer area to be higher than the average value in units of the cycle, and when the average value of the rotational speed of the transfer roller at the time of passage of the portion other than the recess of the transfer roller through the transfer area is higher than the specific value, the speed adjustment mechanism adjusts the rotational speed of the transfer roller at the time of passage of the recess through the transfer area to be lower than the average value in units of the cycle.

3. The image forming apparatus according to claim 2, wherein the first adjustment pattern and the second adjustment pattern adjust the average value of the rotational speed of the transfer roller in units of a cycle, and the speed adjustment mechanism adjusts the rotational speed of the transfer roller so that the average value of the rotational speed of the transfer roller in one cycle in the first adjustment pattern matches the average value of the rotational speed of the transfer roller in one cycle in the second adjustment pattern.

4. The image forming apparatus according to claim 3, further comprising:

a drive roller on which the transfer belt is wound to cause the transfer belt to move;

a torque detector that detects a torque variation of the drive roller, wherein the rotational speed of the transfer roller in the first adjustment pattern and the second adjustment pattern is set based on a result of detection by the torque detector.

5. The image forming apparatus according to claim 4, further comprising:

a belt speed measurer that measures a movement speed of the transfer belt, wherein the rotational speed of the transfer roller in the first adjustment pattern and the second adjustment pattern is set based on a result of measurement by the belt speed measurer.

6. The image forming apparatus according to claim 3, further comprising:

a drive roller on which the transfer belt is wound to cause the transfer belt to move;

a drive source that causes the drive roller to rotate; and a current value detector that detects a current value to be supplied to the drive source, wherein the rotational speed of the transfer roller in the first adjustment pattern and the second adjustment pattern is set based on a result of detection by the current value detector.

7. The image forming apparatus according to claim 6, further comprising:

a belt speed measurer that measures a movement speed of the transfer belt, wherein the rotational speed of the transfer roller in the first adjustment pattern and the second adjustment pattern is set based on a result of measurement by the belt speed measurer.

8. The image forming apparatus according to claim 3, further comprising:

a belt speed measurer that measures a movement speed of the transfer belt, wherein the rotational speed of the transfer roller in the first adjustment pattern and the second adjustment pattern is set based on a result of measurement by the belt speed measurer.

9. The image forming apparatus according to claim 2, further comprising:

a drive roller on which the transfer belt is wound to cause the transfer belt to move;

a torque detector that detects a torque variation of the drive roller, wherein the rotational speed of the transfer roller in the first adjustment pattern and the second adjustment pattern is set based on a result of detection by the torque detector.

10. The image forming apparatus according to claim 9, further comprising:

a belt speed measurer that measures a movement speed of the transfer belt, wherein the rotational speed of the transfer roller in the first adjustment pattern and the second adjustment pattern is set based on a result of measurement by the belt speed measurer.

11. The image forming apparatus according to claim 2, further comprising:

a drive roller on which the transfer belt is wound to cause the transfer belt to move;

a drive source that causes the drive roller to rotate; and a current value detector that detects a current value to be supplied to the drive source, wherein the rotational speed of the transfer roller in the first adjustment pattern and the second adjustment pattern is set based on a result of detection by the current value detector.

12. The image forming apparatus according to claim 11, further comprising:

a belt speed measurer that measures a movement speed of the transfer belt, wherein the rotational speed of the transfer roller in the first adjustment pattern and the second adjustment pattern is set based on a result of measurement by the belt speed measurer.

13. The image forming apparatus according to claim 2, further comprising:

a belt speed measurer that measures a movement speed of the transfer belt, wherein the rotational speed of the transfer roller in the first adjustment pattern and the second adjustment pattern is set based on a result of measurement by the belt speed measurer.

14. The image forming apparatus according to claim 1, further comprising:

a drive roller on which the transfer belt is wound to cause the transfer belt to move;

a torque detector that detects a torque variation of the drive roller, wherein the rotational speed of the transfer roller in the first adjustment pattern and the second adjustment pattern is set based on a result of detection by the torque detector.

15. The image forming apparatus according to claim 14, further comprising:

a belt speed measurer that measures a movement speed of the transfer belt, wherein the rotational speed of the transfer roller in the first adjustment pattern and the second adjustment pattern is set based on a result of measurement by the belt speed measurer.

16. The image forming apparatus according to claim 1, further comprising:

a drive roller on which the transfer belt is wound to cause the transfer belt to move;

a drive source that causes the drive roller to rotate; and a current value detector that detects a current value to be supplied to the drive source, wherein the rotational speed of the transfer roller in the first adjustment pattern and the second adjustment pattern is set based on a result of detection by the current value detector.

17. The image forming apparatus according to claim 16, further comprising:

a belt speed measurer that measures a movement speed of the transfer belt, wherein the rotational speed of the transfer roller in the first adjustment pattern and the second adjustment pattern is set based on a result of measurement by the belt speed measurer.

18. The image forming apparatus according to claim 1, further comprising:

a belt speed measurer that measures a movement speed of the transfer belt, wherein the rotational speed of the transfer roller in the first adjustment pattern and the second adjustment pattern is set based on a result of measurement by the belt speed measurer.

19. The image forming apparatus according to claim 1, wherein the speed adjustment mechanism continuously changes information included in the first adjustment pattern and the second adjustment pattern to be executed based on at least one of a torque variation of a drive roller, a current value to be supplied to a drive source for causing the drive roller to rotate and a movement speed of the transfer belt.

20. The image forming apparatus according to claim 1, further comprising:

a plurality of storage sections configured to store different recording media, wherein each of the first and second adjustment patterns includes a plurality of adjustment patterns corresponding to the plurality of storage sections, and the speed adjustment mechanism executes one of the plurality of adjustment patterns as the first and second adjustment pattern, the one corresponding to one of the plurality of storage sections, which stores the recording medium transported to the transfer area.

* * * * *